US007922029B1

(12) United States Patent
Aretz et al.

(10) Patent No.: US 7,922,029 B1
(45) Date of Patent: Apr. 12, 2011

(54) RECEPTACLE HAVING A TOP INLET, SIDE OUTLET, AND FACILITATED CLEANING

(76) Inventors: Douglas W. Aretz, Cold Spring, MN (US); Steven T. Dorsey, St. Joseph, MN (US)

( * ) Notice: Subject to any disclaimer, the term of this patent is extended or adjusted under 35 U.S.C. 154(b) by 99 days.

(21) Appl. No.: 12/106,302

(22) Filed: Apr. 20, 2008

Related U.S. Application Data

(63) Continuation of application No. 11/078,464, filed on Mar. 11, 2005, now abandoned.

(60) Provisional application No. 60/552,549, filed on Mar. 12, 2004.

(51) Int. Cl.
*B65D 51/18* (2006.01)
*B65D 6/40* (2006.01)

(52) U.S. Cl. ..... 220/661; 220/254.2

(58) Field of Classification Search ..... 220/345.5, 220/345.4, 345.2, 349, 213, 252, 351, 262, 220/669, 212, 601, 661, 495.06, 908.1, 908, 220/909, 345.1, 200, 495.01, 254.2, 254.1, 220/660, 600, 254.9, 812, 811, 826; 312/263, 312/264; D34/7, 1; *B65D 43/12, 43/20, B65D 43/26, 43/18, 43/14, 43/00*
See application file for complete search history.

(56) References Cited

U.S. PATENT DOCUMENTS

| | | | | | |
|---|---|---|---|---|---|
| 1,813,659 | A | * | 7/1931 | Carlson | 206/8 |
| 2,522,391 | A | * | 9/1950 | McGonigle | 119/453 |
| 2,785,562 | A | * | 3/1957 | Tigerman | 69/30 |
| 4,218,103 | A | * | 8/1980 | Bacskay | 312/211 |
| D265,542 | S | * | 7/1982 | Hanson et al. | D34/11 |
| 4,428,493 | A | * | 1/1984 | McDonough | 220/555 |
| 4,457,483 | A | * | 7/1984 | Gagne | 248/97 |
| 4,577,778 | A | * | 3/1986 | Kim | 220/495.07 |
| 4,674,645 | A | * | 6/1987 | Instone et al. | 220/1.5 |
| 5,984,134 | A | * | 11/1999 | Mario | 220/661 |
| 2004/0055913 | A1 | * | 3/2004 | Berry | 206/320 |

* cited by examiner

*Primary Examiner* — Anthony Stashick
*Assistant Examiner* — Robert J Hicks
(74) *Attorney, Agent, or Firm* — Albert W. Watkins

(57) ABSTRACT

A cylindrical receptacle has an open space accessible from above, and an optional cover. An outer shell, an inner liner, and a pair of oppositely moving doors that slide about the circumference define the receptacle. The vertically extending side wall has an opening circumscribing substantially one half of the circumference formed in the side wall. The pair of doors are operative in a first position to fully enclose the opening and are operative in a second position to provide full access to the opening. Various alternative embodiments incorporate vertical reinforcing supports adjacent the opening, gussets circumscribing the opening for reinforcing the opening, a reinforcing spacer adjacent the receptacle top, a discontinuous spacer adjacent the receptacle bottom, a floor adjacent the base and sloped towards the opening, a feature locking the outer shell and inner liner together, and a taper so the receptacle may be stacked together with like receptacles.

20 Claims, 8 Drawing Sheets

FIG. 8
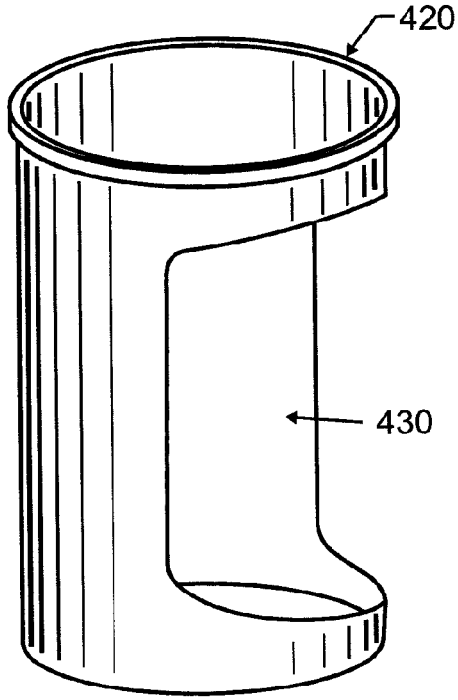
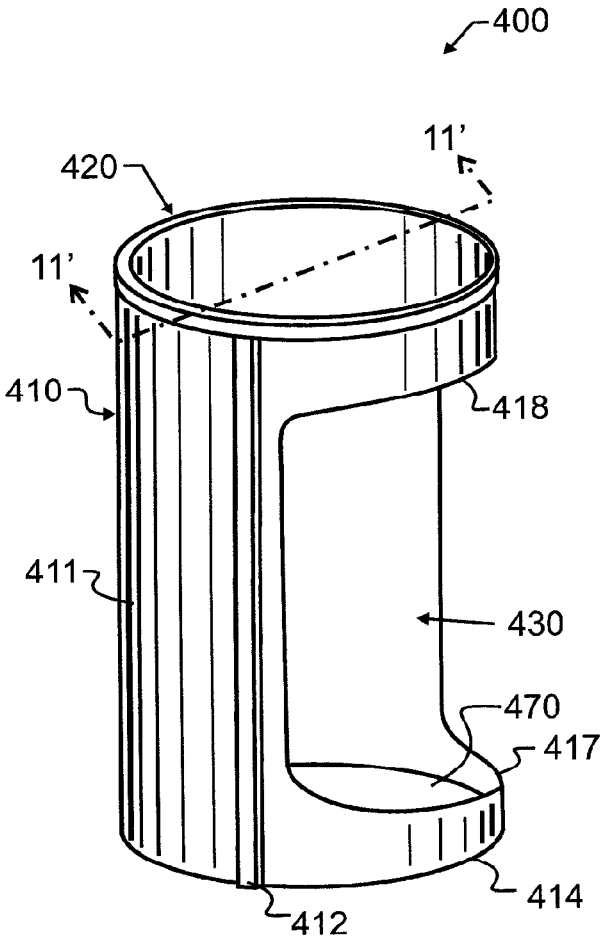
FIG. 7
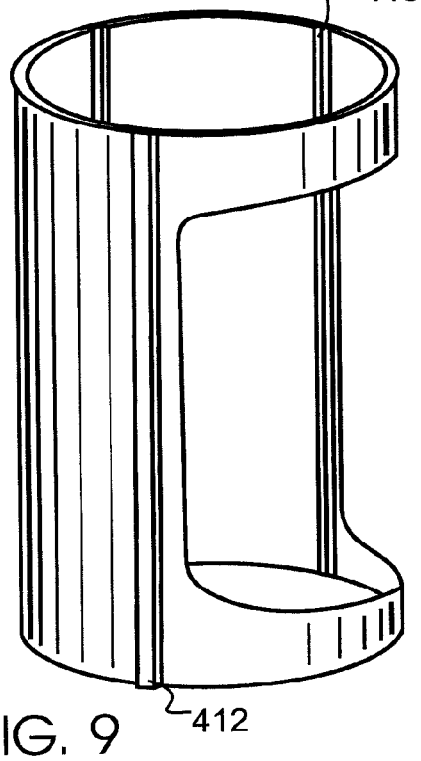
FIG. 9

RECEPTACLE HAVING A TOP INLET, SIDE OUTLET, AND FACILITATED CLEANING

CROSS REFERENCE TO RELATED APPLICATIONS

This application is a continuation of U.S. utility application Ser. No. 11/078,464 filed Mar. 11, 2005 now abandoned of identical inventorship, which in turn claims priority to U.S. provisional patent application Ser. No. 60/552,549 filed Mar. 12, 2004 and having common first named inventor, each entitled "Receptacle", the contents which are incorporated herein by reference in entirety.

BACKGROUND OF THE INVENTION

1. Field of the Invention

This invention pertains generally to receptacles, and more particularly to barrel-shaped containers having a pair of reciprocating closures. In a yet more specific manifestation, the invention pertains to deposit, collection, and distribution receptacles which may be used for laundry or other diverse items. In one very specific manifestation, the invention pertains to receptacles having a top inlet and side outlet.

2. Description of the Related Art

Mankind is gifted with many talents and skills that are quite exceptional in the animal kingdom. Unfortunately, the direct handling and control of many small articles is an area where natural physical talents are more limited than people would desire. Two arms and hands, each hand with five relatively large fingers, provide little with which to grasp and manipulate many discrete and either small or featherweight objects. As a result, the handling of small or featherweight objects has commonly been limited to numbers which may comfortably be directly controlled within one's arms and hands. In many instances, such direct handling and control is extremely inefficient, and other ways have been sought which will improve the efficiencies and effectiveness of the appendages that mankind has been provided with.

Quite commonly, small articles are collected in one or more receptacles, which may either be flaccid bags or rigid containers. Either at predetermined intervals, or once an adequate number of articles have been collected, the articles are either removed into an even larger receptacle, or transported within the receptacle to another location for further processing or activity. The use of a rigid exterior collection receptacle avoids inadvertent tearing of the outer container when impacted by foreign objects, in turn ensuring that the articles remain collected. The rigid container may also be used in combination with and provide support for a flaccid bag, maintaining the bag in proper position and orientation, thereby preventing the bag from falling over and spilling contents. Proper positioning and orientation also permits adjacent space to be used for other activities, thereby better using the space when space is limited. A flaccid bag provides a disposable liner for messy or hazardous materials, thereby preserving a rigid exterior container for additional use without the need for costly cleaning or disinfection. The flaccid bag additionally may be transported with the contents, and then collapsed once the contents are removed therefrom. Consequently, even when the flaccid bag is re-used, the bag will not require significant space when being returned for re-use. Consequently, it is very common and desirable to combine both flaccid bag and rigid exterior shell in the process of collection and transport of small or featherweight articles.

The scope of activities to which this process of collection and subsequent transport or processing is very large. For example, a person trying to maintain a yard having a combination of lawn and trees will be required from time to time to handle both grass clippings and leaves. Commonly, these clippings and leaves will be collected in a bag, and then the bag is used to transport the leaves and clippings to a municipal waste collection site, garbage pick-up, compost facility, or other suitable location. Similar collection and subsequent transport occurs with the collection of trash in waste receptacles, the handling of laundry in hampers and bags prior and subsequent to laundering, the handling of grains, feeds and foodstuffs in agriculture, and many, many other activities too extensive and diverse to list individually. In summary, in many diverse activities and industries, there exists a need for the collection of relatively small articles, followed by further handling subsequent thereto.

The collection of small articles in many cases is best effected using the force of gravity for assistance, rather than relying on a person's limited manipulative skills. So, for example, a person will most preferably place trash in a waste receptacle by dropping the trash into the receptacle from above. In the event there is some fumbling of the trash or aerial or wind deflection, the force of gravity will still draw the trash into the receptacle, consequently simplifying the collection therein. In contrast, the skill required to move many small items such as leaves, grass clippings or paper wrappers either sideways or vertically is often beyond that attainable by most persons. Even where the articles are more easily handled, such as with small linens and the like, gravity assistance reduces the amount of attention or concentration required by a person to ensure the article reaches the receptacle. As a result, the person may more quickly and completely focus concentration on other important tasks.

Vertical collection thereby simplifies collection of small difficult-to-handle articles. However, as the articles accumulate within the receptacle, so does their cumulative weight. While it is relatively easy to drop a few small articles vertically down into a receptacle, the raising of a substantially larger and heavier bag containing many small articles from within such a receptacle in a vertical direction may be far more difficult. In fact, such lifting is potentially very hazardous, and has been the cause of many workplace injuries.

The difficulty of such lifting may best be appreciated from the recognition that lifting requires the application of force opposite that of gravity, or in a vertical direction. In order to lift a bag from a receptacle, the force must then be placed vertically, at or about the horizontal center of the receptacle. For very small receptacles, this may be easily accomplished simply by standing directly over the receptacle. However, when the size of the receptacle starts increasing in size to begin to be sizable fractions of a person, the difficulty of removing a flaccid bag therefrom increases substantially. This is because a person cannot easily reach over the center of the receptacle. Instead, the person must somehow bend to place their arms more nearly over the center. One way this may be achieved is by bending their back, either to lean forward or sideways over the edge of the receptacle. In either case, the person's back and arms must then not only support the person, but also provide adequate support to leverage the lifting of the bag. Such forces are far greater than that which the musculo-skeletal system can safely accommodate, and, as aforementioned, all too often result in injury.

To avoid such hazard, many applications continue to be addressed solely with the flaccid container, without the added benefits that are provided by a rigid outer shell. For other applications, side discharge receptacles have been devised.

Exemplary of one such receptacle is U.S. Pat. No. 4,218,103 by Bacskay, the teachings which are incorporated herein by reference, which discloses a laundry hamper which is filled from the top and emptied through a side panel. A rotating exterior sleeve has an opening that is aligned with an internal opening to gain side access. A similar side access is illustrated by Hanson et al in U.S. design patent D265,542, the teachings which are incorporated herein by reference. Unfortunately, neither of these designs provide full access to the bag. Consequently, removal of the bag is hazardous, both for the operator and for the bag. First, if the bag is relatively full, the opening may not be sufficiently large to permit the filled bag to pass through. In such case, a person must massage the contents within the bag to move the contents through the limited opening. This type of manipulation is both time consuming, and, depending upon the contents of the bag, may be hazardous if the bag should inadvertently rip or tear. If the person instead is in a hurry, the temptation will be to force the bag through the opening. In such case, the bag may be destroyed, and the receptacle may be toppled, neither which is desirable.

Avoiding the limitations created by partial openings, several artisans have created larger openings, such the drop-down side panel illustrated by Mario in U.S. Pat. No. 5,984,134, the teachings which are incorporated herein by reference. Unfortunately, such arrangements are hindered by the potential for ground contact that occurs with the container side, by the generally weakened structure resulting from the separation between receptacle halves, and also by the additional space and obstruction that is created when the container is opened. This last point is somewhat more subtle, but very important. In the Mario patent, while a bag may presumably be more accessible with the side open, in fact the contrary is true. With the side dropped, a person must stand even farther from the bag than they did with the side up. Some benefit is still obtained, since the bag does not have to be lifted vertically as far, but the person still has some vertical lifting required, at an awkward reach.

SUMMARY OF THE INVENTION

In a first manifestation, the invention is, in combination, a generally cylindrical drum having an open space, a base, a vertically extending side wall defining a full circumference about said open space, and a top. The vertically extending side wall has an opening circumscribing substantially one half of the circumference formed in the side wall. A pair of oppositely moving retractable doors are operative in a first position to fully enclose the opening and are operative in a second position to provide full access to the opening.

In a second manifestation, the invention is a receptacle. The receptacle has a top, a base, and a side wall extending between and spacing base and top. The side wall has an opening therein. A guide runs adjacent the side wall. First and second doors are movable through the guide between a first position of contact therebetween blocking access to the opening and a second position of contact therebetween permitting full access to the opening.

OBJECTS OF THE INVENTION

Exemplary embodiments of the present invention solve inadequacies of the prior art by providing a cylindrical receptacle having a top opening with optional cover, an outer shell, an inner liner, and a pair of doors that slide about the circumference of the receptacle.

A first object of the invention is to provide a receptacle which is suitable for containing a liner or bag therein and which has excellent side access that permits side removal of the bag, most preferably with very minimal or no lifting required. A second object of the invention is to provide intuitive and simple side access to the liner or bag without restriction on, use of, or interference with space adjacent the receptacle. Another object of the present invention is to provide a multi-purpose receptacle which may be used for a variety of diverse needs suitable for a plurality of diverse industries. A further object of the invention is to provide a mechanically strong receptacle, which provides full protection for a liner supported therein and capable of both containing and supporting large loads. An even further object of the invention is to provide a sanitary receptacle which may be easily cleaned. Yet another object of the present invention is to provide a receptacle having the foregoing characteristics which is both readily manufactured and reasonably transported.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIG. 7 illustrates a fourth preferred embodiment receptacle designed in accord with the teachings of the present invention from a projected plan view.

FIG. 8 illustrates from a projected plan view a preferred interior shell used in the construction of the fourth preferred embodiment receptacle of FIG. 7.

FIG. 9 illustrates from a projected plan view a preferred exterior shell used in the construction of the fourth preferred embodiment receptacle of FIG. 7.

DESCRIPTION OF THE PREFERRED EMBODIMENT

Figure 2:
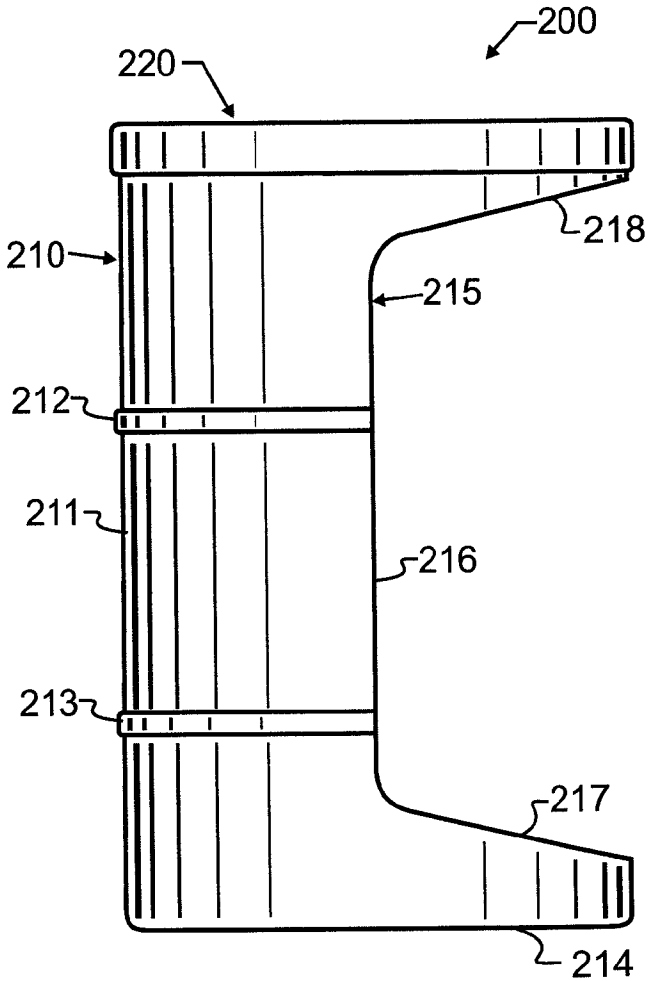
FIG. 2 illustrates a second preferred embodiment receptacle designed in accord with the teachings of the present invention from a side plan view.

Manifested in the preferred embodiments described herein below, the present invention provides a new and novel receptacle which is particularly well suited for the collection of a large numbers of articles that individually may be light, but which collectively are quite heavy. As described herein above and as will be apparent from the following description, those skilled in the art will understand that the present invention is not solely limited to such applications, but is nevertheless particularly well-suited thereto. A number of different embodiments are illustrated and described herein below. For consistency, the numbering of each different embodiment is designated by the first digit of the reference numeral, while like components between different embodiments are wherever possible numbered using identical second and third digits.

Figure 1:
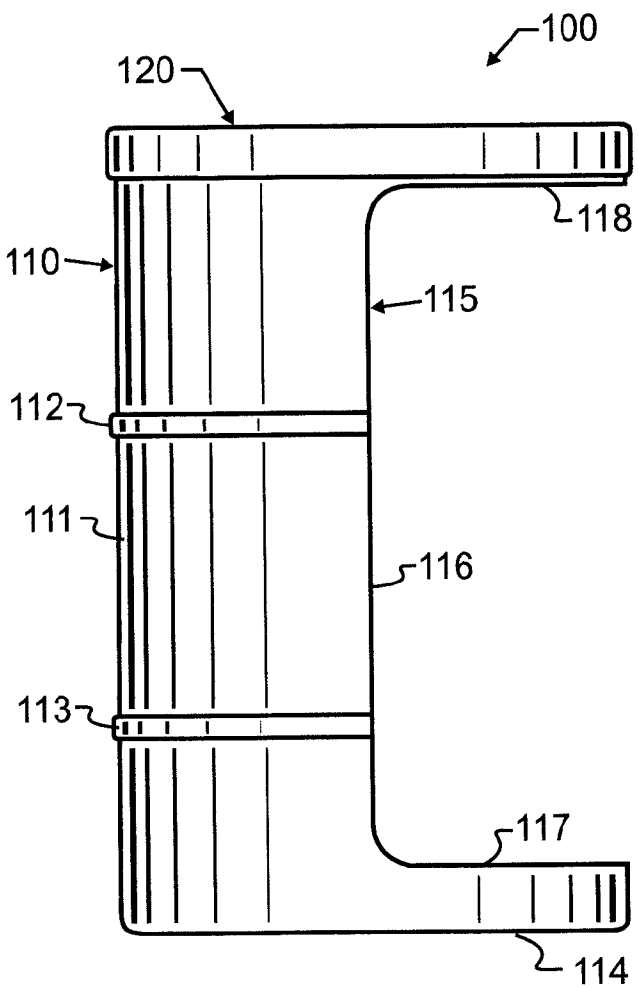
FIG. 1 illustrates a first preferred embodiment receptacle designed in accord with the teachings of the present invention from a side plan view.

In a first preferred embodiment of the invention, a standard 55 gallon polyethylene drum, such as illustrated for exemplary purposes in FIG. 1, is converted into an ergonomically designed receptacle 100. While for the purposes of this disclosure a standard drum is illustrated and converted, it will be understood by those of reasonable skill in the art that in higher volumes, production of custom containers and containers of different sizes and even somewhat different geometries is contemplated herein. Nevertheless, the geometries will remain dictated to some extent by the description of operation which follows herein.

Receptacle 100 is comprised by an outer shell 110 which is preferably formed or cut at opening 115 to leave a top edge 118 and a bottom edge 117 through an approximately semicircle, or 180 degree arc. The balance of receptacle 100 will have full sides 111 about the remaining 180 degrees of circumference. This cut-out 115, as will be described in detail herein below, provides good access to contents within the receptacle. However, the use of a full cut-out 115 which subtends such a large arc may, depending upon the materials used and wall thicknesses, render top rim 120 susceptible to forces applied downward thereon, which might in turn undesirably collapse the top of receptacle 100, or alternatively cause undesirable buckling or bulging along the vertical edge 116 of cut-out 115.

In order to render top rim 120 less susceptible to forces applied thereon, opening 115 may preferably be provided with a gusseted cutout 215, as shown by second preferred embodiment receptacle 200 in FIG. 2. From this figure, it will be apparent that the opening remains at the full 180 degrees, but less access is had at the extremes of the opening adjacent either the top or the bottom, owing to the sloping of top edge 218 and bottom edge 217.

Figure 4:
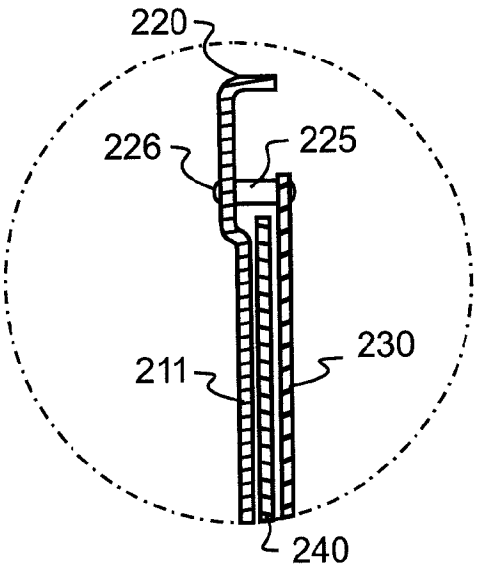
FIG. 4 illustrates the arrangement of inner liner, door, outer liner and top rim of the second preferred embodiment receptacle by enlarged sectional view taken along line 4' of FIG. 3.
Figure 3:
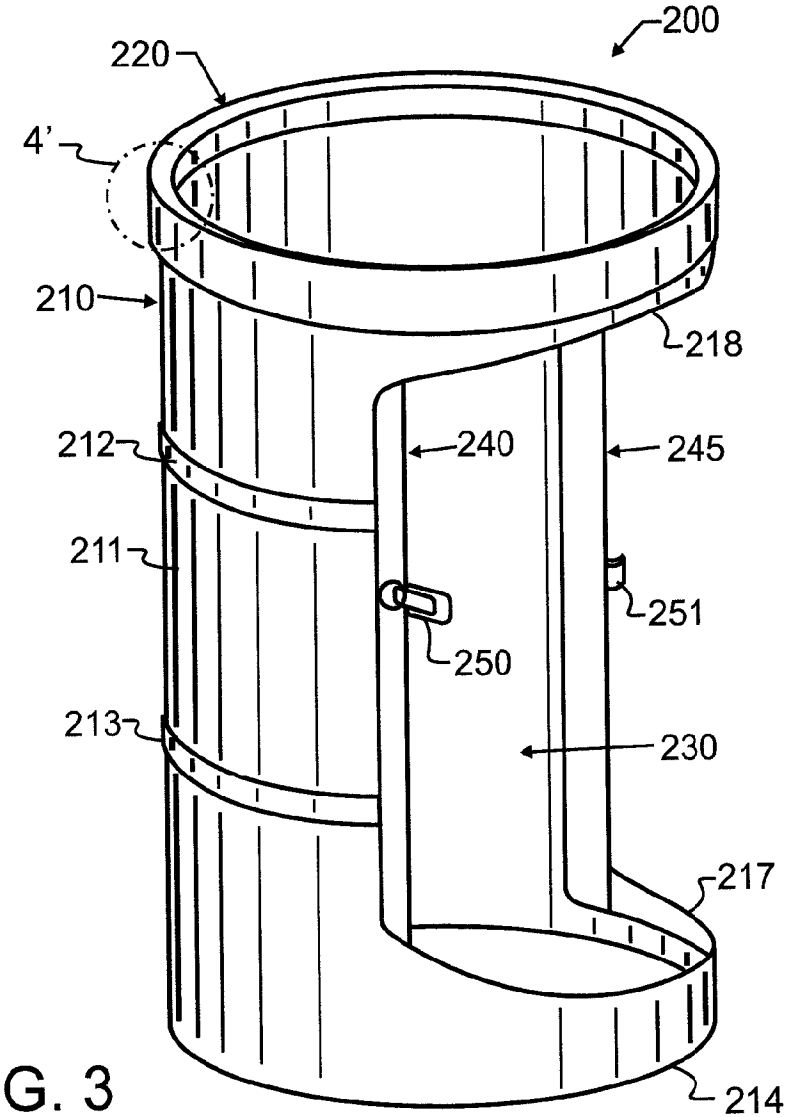
FIG. 3 illustrates the second preferred embodiment receptacle of FIG. 2 from a projected plan view.
Figure 6:
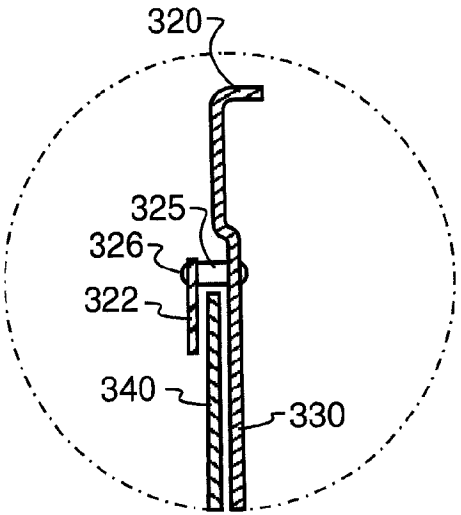
FIG. 6 illustrates the arrangement of inner liner, door, outer liner and top rim of the third preferred embodiment receptacle by enlarged sectional view taken along line 6' of FIG. 5.

FIGS. 1 and 2 illustrated the first and second preferred embodiments from side plan view and without the additional details of the doors shown therein. FIG. 3 illustrates for exemplary purposes and from projected view the second preferred embodiment receptacle 200 including doors 240, 245 and a draw hasp 250, 251 therein. Additionally, the preferred internal shell 230 is illustrated therein. From FIG. 4, it will be apparent that each of the doors 240, 245 slide in a space formed between inner shell 230 and side wall 211. Spacing therebetween is controlled by spacer 225, which may be riveted using rivet 226, though any suitable attachment, including adhesive, thermal staking, plastic welding, or any other suitable technique may be used. In this preferred embodiment receptacle 200, top rim 220 may be formed simply by forming side wall 211 at the top extreme thereof, as visible in FIG. 4. Spacer 225 will most preferably be of adequate thickness to ensure that the sliding doors 240, 245 do not interfere excessively with either shell 230 or exterior side wall 211. Spacer 225 may either be a single unitary hoop, or may alternatively be comprised by a plurality of smaller segments distributed about the circumference. A second spacer, not visible therein, will preferably be provided adjacent the bottom of receptacle 200, and may be different in size, continuity, composition, or other factors from spacer 225. A segmented spacer located just above bottom floor 214 will permit the door track to be cleaned with a liquid, without trapping any of the liquid. The liquid would instead be able to pass directly to the bottom of the barrel. As an option, and where appropriate, the bottom of the preferred receptacle may further be provided with drain holes, permitting such liquid to pass completely out of the receptacle. However, where there is a need or desire to provide better bottom seal against the influx of liquids or pests, such drainage holes would not be incorporated. Additional openings for cleaning or ventilation may be provided at any other suitable location on the barrel, including the side wall, top or bottom as desired or required for a particular application.

Top spacer 225, where required, may be fabricated from material other than polyethylene, and may then be used to provide additional reinforcement to the top of receptacles 100, 200 against a force applied downwardly to rim 120, 220. In such case, spacer 225 would preferably be a single ring encompassing the entire top circumference defined by rim 220. Additional reinforcing members, located at any suitable position, may further be provided if required for a particular application. However, in many cases drums of the prior art are already provided with substantially reinforced top rims, and additional reinforcement is unnecessary. In such case, segmented spacers 225 may also be used adjacent top rim 220. Other spacers may be provided as required to relatively locate shell 230 and side wall 211.

Inner shell 230 prevents contents within the receptacle from interfering with movement of the doors. Without an inner shell or other type of liner, if an object within receptacle 200 at any time presses against outer shell 210, such as at walls 211, doors 240, 245 may be blocked from movement and may potentially not be opened from the side. Furthermore, a more fragile disposable liner bag might unintentionally become snagged and damaged or destroyed from interference with doors 240, 245. With the use of either a rigid or semi-rigid relatively permanent liner such as inner shell 230, a person will be able to slide the door between liner and wall and, in the case of a semi-rigid liner, force the object away from the outer wall sufficiently to permit the door to pass. In such case, a more fragile disposable liner bag would likewise be protected. In addition to the foregoing features, receptacle 200 further incorporates ribs 212, 213, and vertical edge 216 of like character to ribs 112, 113 and vertical edge 116 of receptacle 100.

Figure 5:
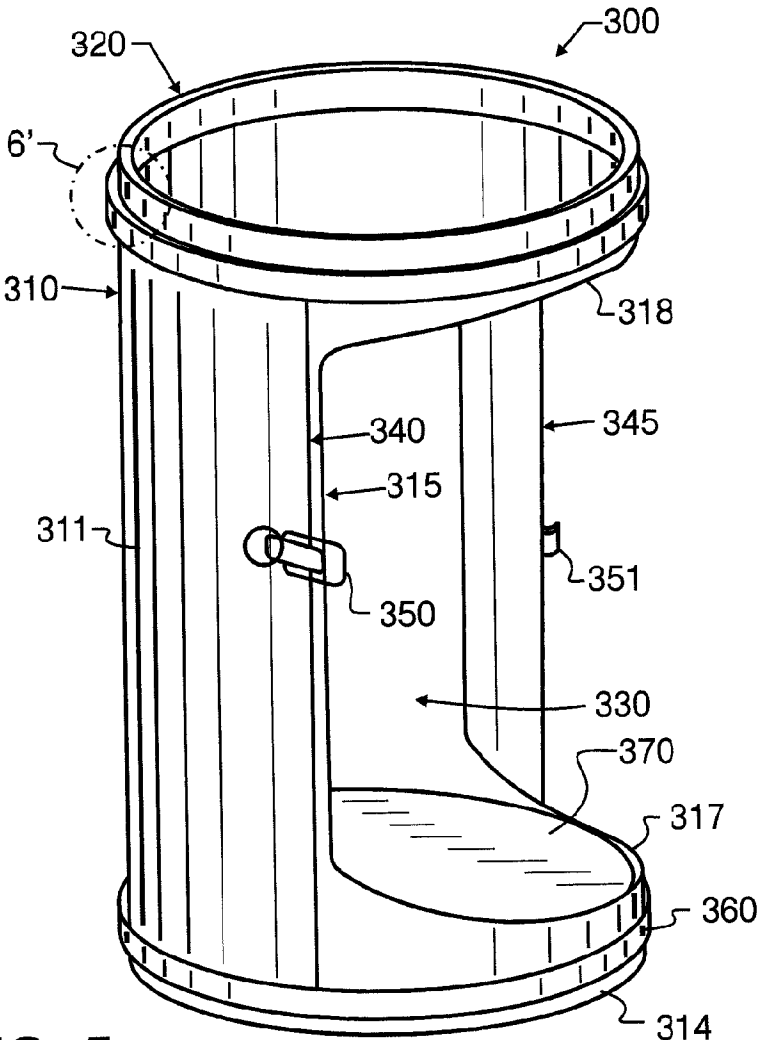
FIG. 5 illustrates a third preferred embodiment receptacle designed in accord with the teachings of the present invention from a projected plan view.

A third preferred embodiment receptacle 300 is illustrated in FIG. 5. As will be apparent therein, doors 340, 345 travel outside of inner shell 330. However, with receptacle 300, there is no outer shell fully encompassing doors 340, 345. Instead, an outer lip 322 and lower lip 360 are provided which retain doors 340, 345 within a proper track. In this embodiment, owing to the exposed exterior, cleaning and sanitization of the track within which the doors travel is greatly facilitated. Unfortunately, there is also a chance for pinching or blockage of doors 340, 345, since the door path is not completely isolated. Because the interior contents of receptacle 300 are retained by wall 311, the only interference with operation of doors 340, 345 would arise from an object external to the drum. Such object may typically be removed readily, and so no separate liner or shell is provided, even though one could be in this alternative embodiment. Once again, the spacer illustrated in FIG. 14 may either be segmented or continuous, as preferred for a particular application.

FIG. 5 illustrates an additional feature which may be implemented in others of the embodiments where suitable and desired. Floor 370 is provided which is elevated from exterior bottom 314, and is additionally sloped from high farther away from opening 315 to lower adjacent thereto, and most preferably is at a height approximately equal to lower opening edge 317. This elevated and sloped floor 370 ensures that a liner placed within receptacle 300 will not require any lifting for removal therefrom, and instead will be assisted during removal by the forces of gravity. Further, when a naturally low cart, dolly, or hand truck toe is placed adjacent to receptacle 300, a flaccid bag or liner may readily be unloaded from receptacle 300 directly onto the cart or hand truck. Consequently, the risk of injury is substantially reduced, if not effectively eliminated. Sloped floor 370 also assists with cleaning and drainage, but may not be suitable for all applications. In some applications, containment of liquids is important. Consequently, either a lip needs provided as in the first two receptacles 100, 200, or special drainage channels must be cut into floor 370 adjacent to opening 315 to prevent escape of liquid therefrom. One skilled in the art will determine the best approach for a given application at the time of design of the particular embodiment. In addition to the foregoing features, receptacle 300 further incorporates top edge 318, top rim 320, spacer 325, and rivet 326 of like character to top rim 220, top edge 218, spacer 225 and rivet 226 of receptacle 200, respectively.

The foregoing preferred embodiment receptacles 100, 200 and 300 may be manufactured using either custom molds, or may alternatively be fabricated from existing relatively standard drums. However, reinforcement of the openings 115, 215, 315 is somewhat challenging. This is because the ordinary reinforcement is from ribs 112, 113, which are designed to maintain the drum in cylindrical shape, and provide no vertical support. However, simply adding vertical supports is not readily practicable, since the vertical support must not only provide resistance to vertical forces, but must also not interfere with the movement of doors about the circumference of these receptacles. Fourth embodiment receptacle 400 provides a novel arrangement and assembly process which permits two or more ribs 412, 413 to be included. While three ribs are illustrated in this embodiment, at least the two ribs 412, 413 are most preferred, since these provide direct vertical support adjacent opening 415.

Figure 10:
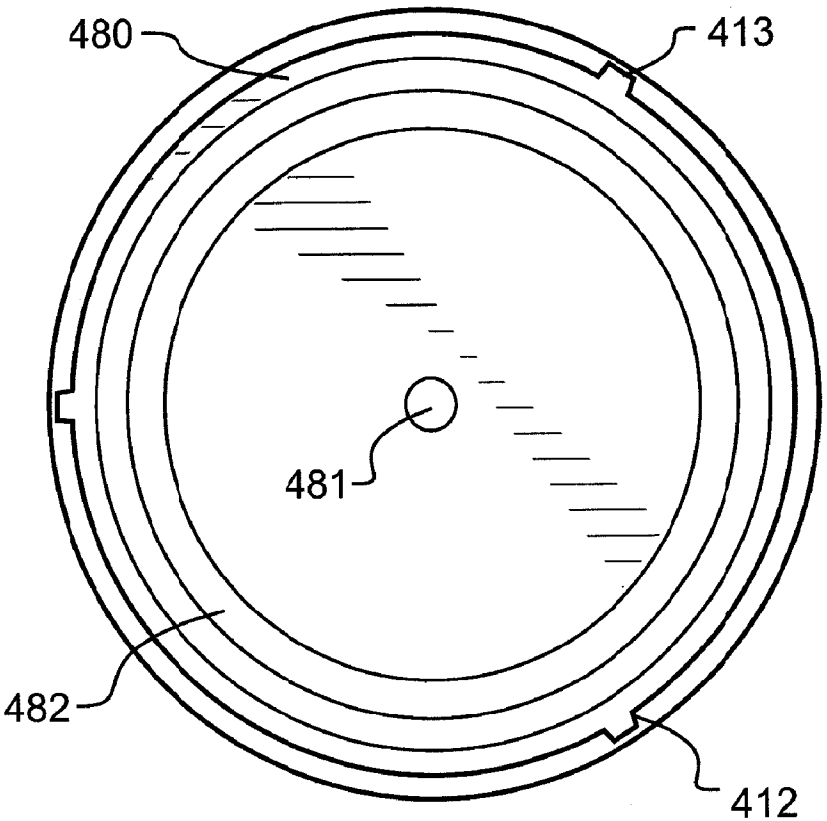
FIG. 10 illustrates the fourth preferred embodiment exterior shell of FIG. 9 from a top plan view looking into the shell.
Figure 13:
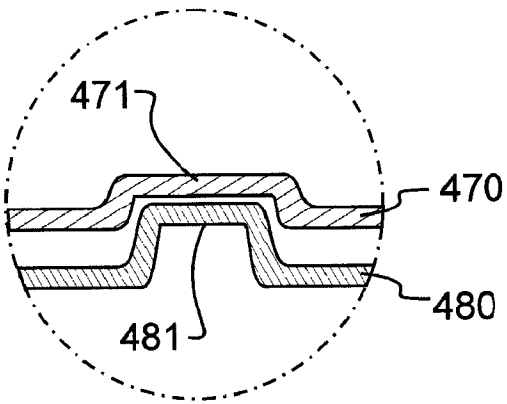
FIG. 13 illustrates the lower center coupling between interior and exterior shells of the fourth preferred embodiment receptacle of FIG. 7 by enlarged side sectional view taken along line 13' of FIG. 11.

FIGS. 8 and 9 illustrate the inner shell 430 and outer shell 410, respectively, and FIG. 10 illustrates outer shell 410 from top view. The geometries illustrated therein are optimized for rotational molding, though it will be understood that any of the embodiments illustrated herein may be fabricated using any suitable techniques or methods. In this embodiment, receptacle 400 may be assembled from the two shells simply by inserting inner shell 430 into outer shell 410. The resulting receptacle 400 is illustrated by cross section in FIG. 11. As may be seen therein and in FIG. 13, several features are preferably provided which facilitate the coupling therebetween. A centering dimple 481 is provided in outer shell bottom 480 which engages with dimple 471 in inner shell floor 470, which ensures proper centering. Where desired, a second "snap-together" element of outer shell wall 411 and inner shell 430 may occur adjacent bottom 470, by designing mating dimples 471, 481 to engage and lock to each other, such as is known in the prior art with regard to snaps and the like. The ability to selectively separate and reattach inner shell 430 to outer shell 410 greatly facilitates cleaning between shells, and thereby improves sanitation where required.

Figure 11:
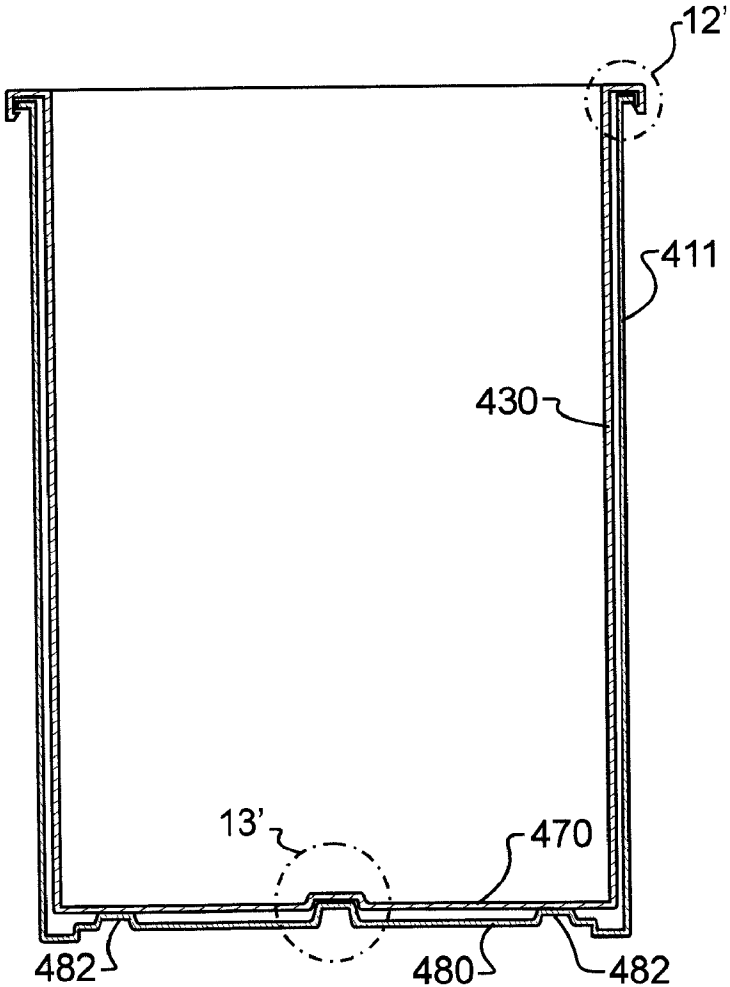
FIG. 11 illustrates the fourth preferred embodiment receptacle of FIG. 7 by side sectional view taken along line 11' of FIG. 7.

One or more supports 482 visible in FIG. 11 may be provided which further support floor 470. The placement and physical geometry of these supports 482 is not critical to the workings of the invention, and may not be necessary, depending upon the anticipated load upon floor 470, the materials and thicknesses used, and the like. Nevertheless, such dimpling provides additional structural integrity to floor 470, and is therefore preferred. In the embodiment illustrated, support 482 is a generally circular ridge which distributes forces and helps to prevent buckling in floor 470.

Figure 12:
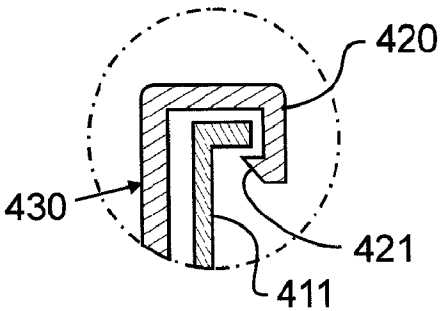
FIG. 12 illustrates the upper coupling between interior and exterior shells of the fourth preferred embodiment receptacle of FIG. 7 by enlarged side sectional view taken along line 12' of FIG. 11.

FIG. 12 illustrates the upper rim of receptacle 400 from an enlarged cross-section view, and additionally illustrates the optional locking ridge 421. As may be apparent, when inner shell 430 is inserted into outer shell 410, ridge 421 will deform slightly as it passes the uppermost flange of shell wall 411 shown in FIG. 12. This deformation can be controlled by the relative sizes of features shown in FIG. 12. Furthermore, the ease by which inner shell may be both inserted and removed from outer shell 410 will be dependent not only upon the size of ridge 421, but also upon the geometry of the ridge. For exemplary purposes, an equilateral triangular cross-section will permit both insertion and removal using approximately equal force. However, ridge 421 may be shaped so that the surface most adjacent to the flange of shell wall 411 is parallel thereto, while the side distal therefrom is sloped. Such arrangement will permit ready coupling of inner to outer shell, and will also strongly prevent separation therefrom. Consequently, simply by changing the slope of the surfaces upon ridge 421, and with similar changes to shell 410 available, the coupling characteristics can be easily controlled between inner and outer shells 430, 410.

While not separately illustrated, it is contemplated herein to additionally include members to force orientation of inner shell 430 properly with outer shell 410. A number of techniques are known in different industries, typically referred to as alignment guides, keying structures, alignment pins, or the like which properly "clock" or orient the components. In addition to the foregoing features, receptacle 400 further incorporates top edge 418 and top rim 420 of like character to top edge 218 and top rim 220 of receptacle 200, respectively, and exterior bottom 414 and lower opening edge 417 of like character to exterior bottom 314 and lower opening edge 317 of receptacle 300, respectively.

Figure 14:
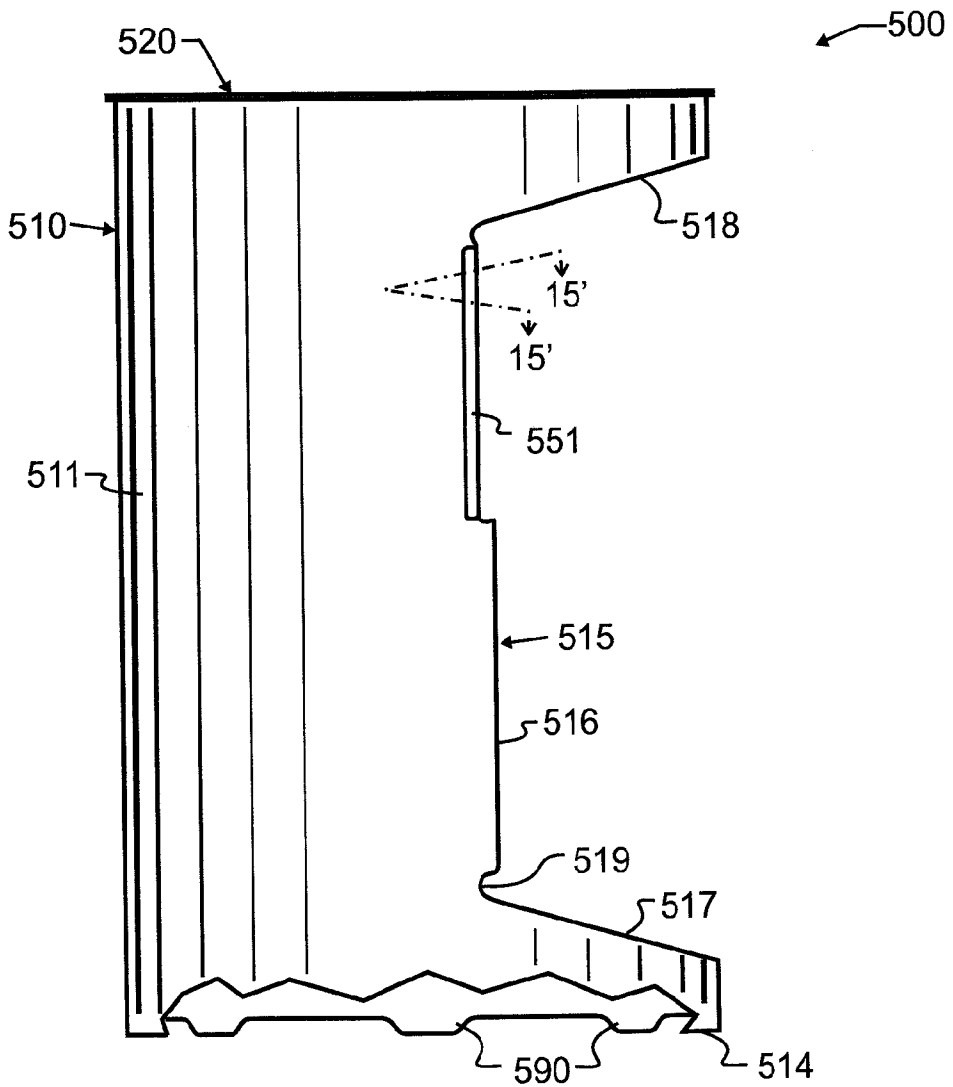
FIG. 14 illustrates a fifth preferred embodiment receptacle designed in accord with the teachings of the present invention from a side plan view.
Figure 16:
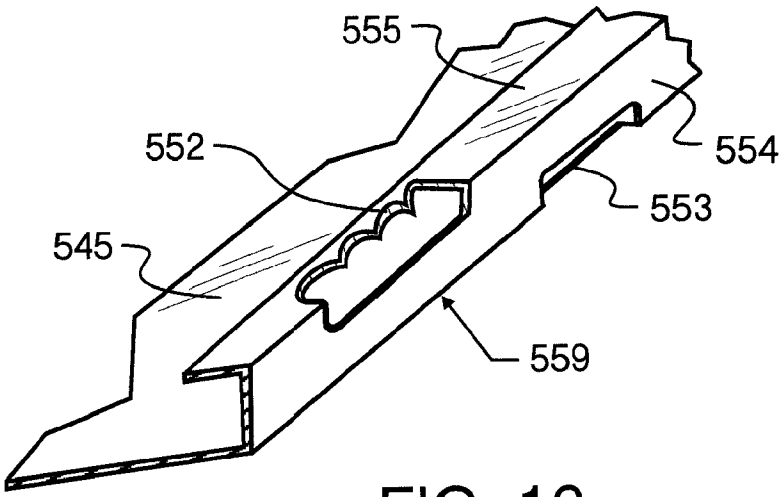
FIG. 16 illustrates a preferred handle used in the fifth preferred embodiment from partial projected and enlarged view.
Figure 17:
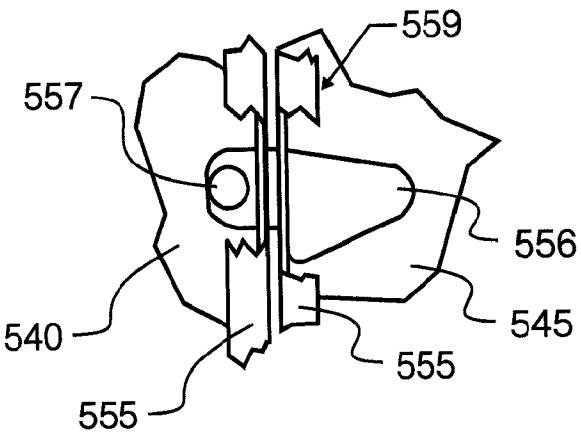
FIG. 17 illustrates a preferred latch used with the preferred handle of FIG. 16, showing the latch engaged.
Figure 15:
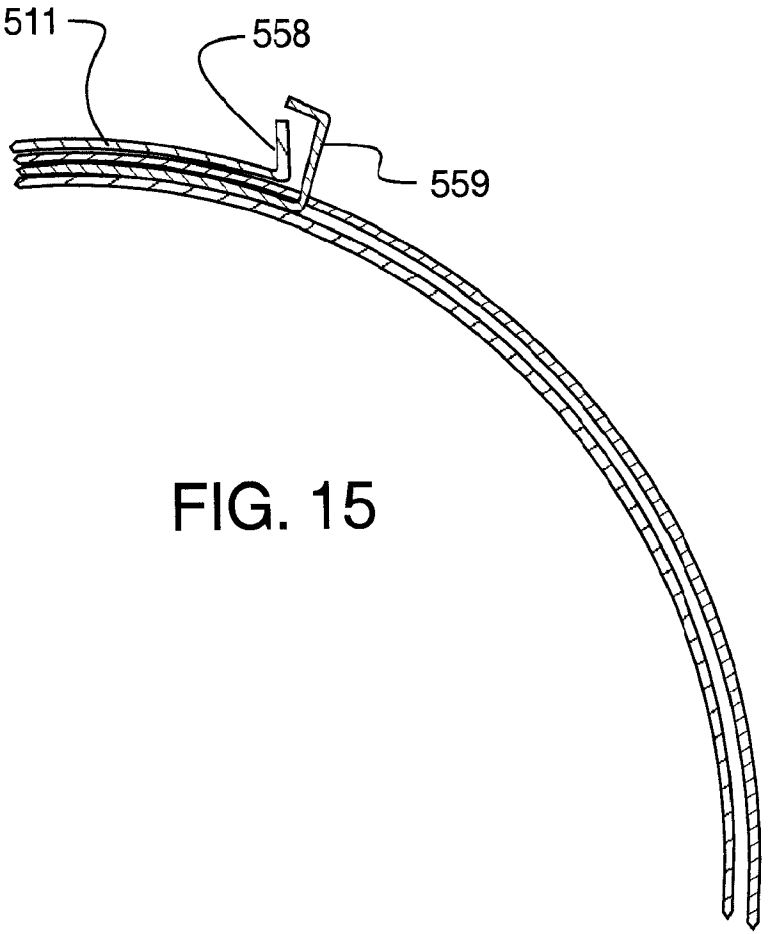
FIG. 15 illustrates a preferred door limit and door combination used in the fifth preferred embodiment from top sectional view taken along line 15' of FIG. 14.

A fifth preferred embodiment receptacle 500 is illustrated in FIG. 14. This embodiment has been designed to facilitate fabrication from sheet stock. Consequently, the features found therein are developed by selective deformation of the sheet stock. Once again, while fabrication from sheet has been optimized, the teachings of features found herein will be understood to be applicable to other fabrication techniques as well, as will be understood by those skilled in the art. Receptacle 500 includes floor supports 590, which may take on any suitable geometry. These supports are strategically located within base 514 to best suit an intended application and load rating. Adjacent to cut-out 515 is formed handle 558, which is not only operative as a manual grasping point, but which also through folding provides significant vertical load support adjacent cut-out 515. In order to provide good strength and reduce potential materials fatigue, rounding may be provided at various junctions to avoid stress concentrations, such as illustrated by cut-out 519. The location of door 545 within receptacle 500, when adjacent handle 558, is illustrated in FIG. 15. The geometry of a preferred handle 559 for sliding doors 540, 545 is illustrated in FIG. 16. A manual grasping cut-out 552 may be formed therein primarily in handle face 555, while a notch 553 may desirably be formed adjacent to handle face 554. The operation of notch 553 is best understood from FIG. 17, where latch 556, which is pivotal about pivot 557, passes therethrough. An additional locking system such as is known in the art of catches and the like may be provided where necessary and so desired, and might be incorporated directly with latch 556. Furthermore, other suitable latches may be provided. As will be understood, any suitable type of latch may be used to secure the doors of any of the preferred embodiment receptacles in a closed position. Springs or other mechanisms may be provided to mechanically assist with either or both opening and closing of the doors. Furthermore, any type of lid or cover for the receptacle may be provided, including pivoting, spring assisted, or other such lids, or even no cover at all, depending upon the needs of a particular application. In addition to the foregoing features, receptacle 500 further incorporates vertical edge 516, bottom edge 517, top edge 518, and top rim 520 of like character to vertical edge 116, bottom edge 117, top edge 118, and top rim 120 of receptacle 100, respectively, draw hasp 551 of like character to draw hasp 251 of receptacle 200, and outer shells 510 and outer shell wall 511 of like character to outer shells 410 and outer shell wall 411 of receptacle 400, respectively.

While not separately illustrated, it will be understood that the receptacles may be provided with interior shelves where desired. Furthermore, these shelves may be provided with an axis of rotation extending generally vertically within the longitudinal axis of the drum, or co-axial with the center of the vertical wall. Such shelves would then be rotatable to provide ready access to any items stored thereon. A lock may also be provided for selectively preventing the shelves from rotating.

Additional alternative embodiments contemplated herein incorporate casters or wheel sets underneath the receptacles, most preferably supporting bottom 114 from or above the ground. For exemplary purposes only, and not limited thereto, a "dolly" system of 4-5 casters may be independently attached, thus allowing the user to attach the dolly system or use the receptacle without. In an alternative, two larger wheels at the back side of the receptacle may be provided which might be more applicable for outdoor use. A two wheel embodiment would require slight tipping while wheeling about. Holes or cutouts may additionally be provided to the upper rim, door handles, and elsewhere on the receptacle as needed, that may accommodate industry specific attachments. Exemplary of such attachments, though not limiting thereto, are holes and hooks to support tools used in the provision of janitorial services. The receptacles may further be equipped with a handle for transporting purposes. The handle could, for exemplary purposes, be provided at the top adjacent the rear side, and may extend across some portion of or the entire width of the receptacle.

In a yet further alternative embodiment, receptacles designed in accord with the teachings of the present invention may additionally be tapered from top to bottom, at an angle contemplated to be from three to five degrees, though not limited solely thereto. Such angle will permit multiple receptacles to be stacked together, with, to some degree, the bottom of one barrel fitting inside the top opening of another. This feature is very cooperative with the separable liners such as found in receptacle 400, since a large number of inner liners 430 may be stacked together with each other for compact storage, inventory and shipping, and, likewise, a large number of outer shells 410 may separately be stacked with like outer shells. The extent of the angle will dictate the degree of stacking, and the features that may be accommodated within a part and still permit such stacking.

The preferred and alternative embodiment receptacles illustrated herein are most preferred for several applications that have been particularly vexing in the past. One of these is the collection of items, refuse, laundry, or any other diverse materials within a container, followed by the removal of such materials therefrom. In order for such removal to occur, the prior art systems frequently required a person to remove the items from the top, along a vertical axis. Essentially, the items were removed along the same axis as they were deposited. Such lifting is at angles which are very poor for a human, and therefore applies undesirable forces and strains to the human anatomy. Consequently, many workplace injuries result from the use of such receptacles. The present invention permits a person filling from the top, and then removing from the side, thereby avoiding such injury.

Figure 18:
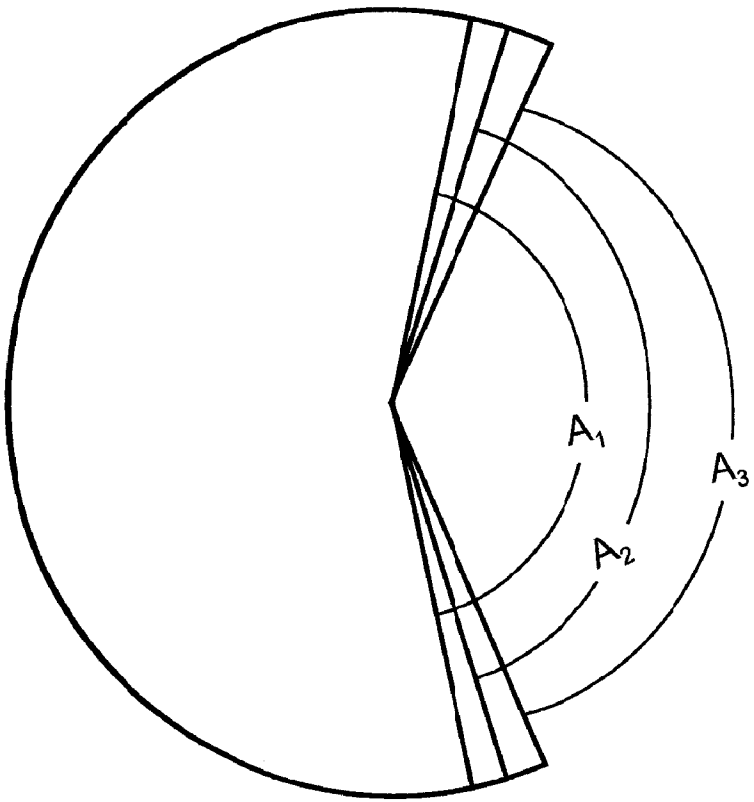
FIG. 18 illustrates the various angles that are subtended by incremental changes to the extent of side opening provided.

Unlike other prior art systems, the present invention permits access to the contents of the container from a much larger angle of access. Said another way, if a bag is used within a prior art receptacle, and the bag is filled full with many smaller articles, then the bag will not be readily removed without risking the tearing of the bag against the opening. This is because the bag is larger than the less-than-180-degree opening, and the bag will need to be deformed as it passes therethrough. In accord with the teachings herein, a receptacle may be designed which permits the entire bag to be removed without risking interference from the opening. The effect and consequence of this is best illustrated in FIG. 18. As shown therein, a number of angles A1, A2 and A3 are illustrated, representative of the angle of access to an internal flaccid bag or liner. The opening, with an additional one-half inch of material, will be reduced to from 180 degrees to approximately 156 degrees. The consequence of reducing the opening by either one or two inches results in openings of 146 and 132 degrees, respectively. As should be apparent from the foregoing figures and description, even very small amounts of additional material can significantly adversely impact the available angle of opening into the receptacle. Consequently, the present invention will most preferably be designed to minimize any such reduction.

In the preferred embodiments illustrated and described herein, the doors travel inside of the drum wall. The use of two doors permits the receptacle to be opened to angles larger than 180 degrees, when desired, and potentially by as much as 270 degrees if needed or appropriate. To obtain either a full 180 degree opening or more, the doors must be designed to overlap each other as they are opened beyond an angle of close to 180 degrees. The reason the angle will not be a full 180 degrees without overlapping the opened doors is because the doors will normally be designed to overlap, when in a closing position, by some amount with the drum wall and potentially with each other. These overlaps will result in the doors extending about an arc greater than 180 degrees when opened, unless the opened doors will also overlap each other. As the illustration of FIG. 18 demonstrates, even a small closed-door overlap will significantly reduce the available angular opening, if the doors do not overlap when opened.

A very consequential benefit of the preferred receptacles 100-500 is the preservation of space adjacent the receptacle. In the prior art, standard square cabinets and lockers include doors that swing out to open. The doors block the walkway adjacent to the cabinet. Consequently, where space is at a premium, the doors are sometimes unacceptable, and even hazardous. The present receptacle not only provides vastly improved ergonomic access as already discussed, but additionally permits relatively higher density storage than standard square receptacles where passageways are needed to be kept open or where there simply is not enough space to accommodate such swinging doors.

Several additional features and options should now be more apparent. First of all, the present receptacle may be manufactured from a variety of materials, including metals, resins and plastics, ceramics or cementitious materials, or even combinations of the above. The specific material used may vary, though special benefits are attainable if several important factors are taken into consideration. Firstly, the receptacle should be designed to have a mass suitable for the intended application. For example, when used for garden refuse collection, the receptacle should be sufficiently light to enable even a relatively frail landscaper, decorator or homeowner to move the receptacle about. However, when used where massive articles may be "tossed" into the receptacle, or outdoors in a fixed location where ordinary moving or removal is undesired, then the receptacle may be designed using much more massive materials, including concrete. Most preferably, the receptacle will also be sufficiently weather resistant and durable to withstand the particular climate for the intended application, including any forces that may be applied that could tend to fracture or otherwise damage the receptacle. The most preferred materials are plastics, which may or may not include various reinforcing fibers or particles, and other ingredients known to enhance the properties and weather resistance of the composition and resulting product. The plastics may be modified to have adequate resistance to environment, may include fire retardants, germicidal additives and other suitable characteristic enhancing compounds, and are accompanied by low cost and ready manufacture to custom geometries.

Where plastics are used and a tighter fit or seal is required for the receptacle, additional features may be provided to ensure tight engagements and closures. These additional features may include interlocking tapers, O-rings, gaskets or other such features as may be known in the art of coupling and sealing and which may be desired herein. For many typical applications, however, there will not be a need for tighter coupling than would be achievable from ordinary production tolerances and material compliance.

A variety of designs have been contemplated for the preferred receptacles. These designs may extend beyond the standard cylindrical construction illustrated herein, and may include various artistic or thematic configurations as well. Fire hydrants, fountains, wishing wells, tree stumps, various creature, fantasy or human figures, flower planters, columns, cactus and a myriad of other thematic displays may be constructed. The materials used for a particular design may be chosen not only based upon aforementioned factors such as weather resistance and weight, but may also factor in the particular design. For exemplary purposes only, a cast metal fire hydrant offers a particular amount of authenticity which would otherwise be unattainable with other materials. Consequently, the present invention may, where desired, be designed to address both aesthetic issues and safety issues.

The preferred receptacles 100, 200, 400 and 500 may additionally be produced as a fully enclosed container, without door cutouts, such as 115, or any other penetration to the inner and outer shell. In such case, these receptacles may then serve as a double-walled transport container. As a double-walled barrel, insulating the space between the inner and outer shell will provide for protecting the material contents, whether liquid or solid, from weather elements or damage. Where such dual use is contemplated, the tooling and production techniques should be selected to permit a manufacturer to control or elect which receptacles include cut-outs and which do not.

While discussed herein above as separate components, it is further contemplated that separately described or illustrated components within each of the preferred receptacles may in fact be formed unitarily with other components, and any specific recitation or lack thereof is not indicative of the particular construction. For exemplary purposes only, it is conceivable that the inner and outer shells described herein may be fabricated as a single unit. While not all receptacles may be suited for such construction, and while sanitation may be complicated by such unitary construction, such concept is certainly contemplated herein and will be used by a skilled artisan where appropriate in light of the present disclosure.

While not specifically discussed heretofore, specific support may additionally be provided for removable flaccid liners. Support may include a serrated edge, dull and non-invasive, intended to hold the bag liner in place, specific clamps, or the myriad of other techniques known in the art of receptacles for supporting flaccid liners therewith.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

We claim:

1. A receptacle for receiving and retaining articles through a top opening and selectively discharging said articles through a side opening, comprising, in combination, a generally cylindrical drum having an open space and defining said top opening, a base, a vertically extending side wall defining a full circumference about said open space, and a top, said vertically extending side wall having an opening circumscribing substantially one half of the circumference formed in said side wall and thereby defining said side opening;

a pair of oppositely moving retractable doors operative in a first position to fully enclose said opening and operative in a second position to provide full access to said opening; and a second vertically extending side wall co-axial with and separable from said vertically extending side wall and having an opening corresponding to said vertically extending side wall opening;

said pair of oppositely moving retractable doors located substantially entirely between said vertically extending side wall and said second vertically extending side wall in said second position.

2. The receptacle of claim 1 further comprising vertical supports adjacent said vertically extending side wall opening.

3. The receptacle of claim 1 further comprising at least one gusset circumscribing said vertically extending side wall opening and adjacent one of said drum base and said drum top.

4. The receptacle of claim 1 further comprising a means for locking said vertically extending side wall to said second vertically extending side wall.

5. The receptacle of claim 4 wherein said locking means further comprises a selectively sloped ridge cooperative with a flange.

6. The receptacle of claim 1 further comprising a means for retaining a flaccid bag adjacent said vertically extending side wall.

7. A receptacle, comprising:

a top through which articles may pass and be collected within said receptacle;

a base;

a side wall extending between and spacing said base and said top and having an opening therein;

a guide adjacent said side wall defining a door path circumscribing a complete circle;

first and second doors movable through said guide between a first position of contact therebetween and blocking access to said opening and a second position of contact therebetween permitting full access to said opening; and a liner interior to, spaced and fully removable from said side wall, defining a space between said liner and said side wall substantially capturing said first and second doors when in said second position of contact.

8. The receptacle of claim 7, further comprising reinforcing supports adjacent said opening.

9. The receptacle of claim 7, further comprising a snap coupling said side wall and liner together.

10. The receptacle of claim 7, further comprising a taper from top to bottom such that said receptacle has a larger inside diameter adjacent said top than an outside diameter adjacent said base.

11. A sanitary receptacle which is operatively assembled for receiving matter through a top, accessible through the side to remove matter accumulated within said receptacle, and disassembled to provide direct access to all surfaces for cleaning and sanitation, and which may be repeatedly assembled to receive matter and disassembled for cleaning and sanitation, comprising:

an outer shell having a base and vertically extending from said base and defining a full circumference about an open space and having an opening formed in said outer shell circumscribing substantially one half of said full circumference;

an inner liner having a base and vertically extending from said base within said open space, repeatedly separable from and assembled with said outer shell, and having an opening corresponding to said outer shell opening;

at least one door operative in a first position to block said matter from passing from within said open space through said inner liner opening and said outer shell opening, and operative in a second position to permit said matter to pass from within said open space through said inner liner opening and said outer shell opening, said at least one door fully separable from said inner liner and outer shell; and a top defining an opening into said open space through which said matter may pass;

said at least one door, said inner liner and said outer shell each separable from each other to permit cleaning of all surfaces of all components of said sanitary receptacle and reassembly thereafter for re-use.

12. The sanitary receptacle of claim 11 wherein said outer shell further comprises reinforcing supports adjacent said outer shell opening.

13. The sanitary receptacle of claim 11 further comprising at least one gusset circumscribing said outer shell opening and adjacent one of said outer shell base and said top.

14. The sanitary receptacle of claim 11 further comprising a means for locking said inner liner to said outer shell.

15. The sanitary receptacle of claim 14 wherein said locking means further comprises a selectively sloped ridge cooperative with a flange.

16. The sanitary receptacle of claim 11 wherein said outer shell is tapered from top to bottom to have a larger inside diameter adjacent said top than an outside diameter adjacent said outer shell base.

17. The sanitary receptacle of claim 11 further comprising a means for retaining a flaccid bag interior of said inner liner.

18. The sanitary receptacle of claim 11, wherein said inner liner is co-axial with said outer shell.

19. The sanitary receptacle of claim 11, further comprising a door guide between said inner liner and said outer shell, said at least one door traveling primarily within said door guide.

20. The sanitary receptacle of claim 19, wherein said at least one door further comprises a pair of oppositely moving doors.

* * * * *